United States Patent [19]

Heyl

[11] 4,216,704

[45] Aug. 12, 1980

[54] PISTON FOR A HYDROSTATIC AXIAL-PISTON MACHINE

[75] Inventor: Walter Heyl, Johannesburg, Fed. Rep. of Germany

[73] Assignee: Linde Aktiengesellschaft, Wiesbaden, Fed. Rep. of Germany

[21] Appl. No.: 854,051

[22] Filed: Nov. 23, 1977

[30] Foreign Application Priority Data

Nov. 26, 1976 [DE] Fed. Rep. of Germany ..... 2653866

[51] Int. Cl.[2] ..... F15B 21/04

[52] U.S. Cl. ..... 92/78; 91/488; 92/158; 92/181 R

[58] Field of Search ..... 91/488; 92/78, 172, 92/181 R, 181 P, 158

[56] References Cited

U.S. PATENT DOCUMENTS

| | | | |
|---|---|---|---|
| 1,466,773 | 9/1923 | Trew | 92/78 X |
| 2,299,235 | 10/1942 | Snader et al. | 91/488 |
| 3,066,609 | 12/1962 | Hann | 91/488 X |
| 3,106,138 | 10/1963 | Thoma | 92/156 |
| 3,828,654 | 8/1974 | Wiethoff | 92/158 X |
| 3,915,071 | 10/1975 | Forster | 92/181 P |

*Primary Examiner*—Irwin C. Cohen
*Attorney, Agent, or Firm*—Karl F. Ross

[57] ABSTRACT

A piston for a hydrostatic piston machine, especially an axial-piston pump or motor in which the piston is formed with a ball head riding in a slide shoe which is supported by a fluid-pressure cushion against a countersurface, e.g. a swashplate. The piston is formed with a central passage which communicates with a bore in the ball head, this bore being provided with a throttle to prevent the fluid medium from being forced at an excessive rate into the fluid-pressure cushion and thereby lift the shoe from the countersurface. According to the invention, the end of the piston remote from the ball head is provided with a gap filter of large area and narrow gap width to prevent large particles from entering and blocking the passage and the throttle.

1 Claim, 8 Drawing Figures

PISTON FOR A HYDROSTATIC AXIAL-PISTON MACHINE

FIELD OF THE INVENTION

The present invention relates to a piston for a hydrostatic piston machine, especially for an axial-piston machine and, more particularly, to a piston provided with a central passage which communicates with a cushion in a slide shoe which is disposed between a ball head of the piston and a reaction surface.

BACKGROUND OF THE INVENTION

An axial-piston pump or motor, i.e. an axial-piston hydrostatic machine, generally comprises a cylinder drum rotatable about an axis and formed with a plurality of angularly equispaced cylinder bores, each of which receives slidably a piston having a ball head external of the cylinder drum and bearing upon a reaction surface which may be tilted to control the displacement of the machine. The reaction surface, e.g. a swashplate, may be engaged by a respective slide shoe which has a socket receiving the ball head of the respective piston.

In swashplate-type machines of this kind, it is a common practice to provide a hydraulic-medium cushion within the guide shoe which is maintained under pressure by a passage traversing the piston and communicating, at the working end thereof, with the compartment or chamber of the cylinder bore which receives the hydraulic fluid from or delivers the hydraulic fluid to a valve plate or control surface upon which the cylinder rides.

The purpose of this cushion is to provide a lubricating film between the shoe and the reaction surface along which the shoe slides and, in addition, to maintain a floating relationship between this shoe and the reaction surface. The fluid delivered to the cushion also lubricates the juxtaposed surfaces of the piston head and its socket.

In conventional machines of the aforedescribed type, the pressure in the pressure cushion corresponds to the pressure at the working-end face of the piston and can correspond hydrostatically to the force which is applied by the piston to the reaction surface.

To this end, the cushion is connected to the working chamber ahead of the working end face of the piston.

In order to reduce the inertia of the cylinder drum and piston assembly which is rotated about the axis of the cylinder drum, the piston may be made hollow and can be provided with a post connecting the ends of the piston and provided with a passage which delivers the hydraulic medium from the working end of the piston to the bore provided in the ball head thereof.

It is important to prevent an excess flow of fluid to the pressure cushion and, therefore, a lifting of the slide shoe away from the reaction surface with escape of fluid to an excessive degree. To this end, the passage between the working chamber of the cylinder and the fluid cushion is provided with a throttle which ensures delivery of the pressurized fluid to the fluid cushion but prevents an excessively rapid flow thereto.

With such a throttle constriction, however, there arises the danger that impurities or contaminants entrained in the fluid medium will plug the constriction and prevent further flow of the pressure medium to the cushion. As a result, the slide shoe may come to rest around its periphery with the full piston force against the reaction surface and result in excessive wear of the shoe and the reaction surface upon which the shoe rides.

It should be mentioned that pistons having fine filters are already known and these filters serve to trap the impurities and prevent them from entering the pressure cushion. When such contaminants are allowed to pass into the pressure cushion, they can pass between the edge of the slide shoe and the reaction surface upon which the latter rides and cause wear of these juxtaposed faces.

Such filters, however, must be designed so that their useful life corresponds to the useful life of the entire axial-piston machine since a replacement of the filters during the normal life span of the machine cannot be done effectively. In other words, in order to make the machine as maintenance-free as possible, the filters cannot be so positioned and designed that they are replaceable.

These requirements create new difficulties. Firstly, the filters must be relatively large and of complicated construction to ensure that they will not become plugged by the contaminants which may be carried by the fluid medium. In fact, because of the complexities involved in designing and constructing pistons having fine filters therein, it has been found to be essential to carry out a fine filtering of the hydraulic medium before it enters the transmission or machine so as to minimize the contaminant pickup by filters in the pistons.

Naturally, even this expedient does not prevent large particles from penetrating into the pistons and such particles may block a substantial portion of the flow cross section of the piston passage. If any such particles should happen to reach the throttle, the disadvantages previously mentioned arise.

Even a fine filtering of the fluid medium does not exclude this possibility because, in many instances, the contaminants arise from wear of particles on the seals of the machine, e.g. the sealing rings or O-rings which are commonly used therein.

Sieve-type filters have been provided in pistons as well but have been found to be ineffective under the acceleration forces which operate upon the pistons. The mechanical characteristics of sieve filters also pose difficulties if long useful lives are to be ensured.

OBJECTS OF THE INVENTION

It is the principal object of the present invention to provide an improved piston having a throttle of the type described whereby the disadvantages enumerated above are avoided.

Another object of the invention is to provide a piston having a throttle constriction and, ahead of this constriction, a filter which minimizes the passage of contaminants to the throttle and, in addition, has a useful life which can be equal to or greater than the useful life of the other components of the hydraulic machine.

Still another object of the invention is to provide a piston for an axial-piston machine which has a filter built into it and capable of impeding the passage of particles of a size capable of plugging the throttle constriction, which filter can be inexpensively and readily fabricated and which has a long operational life before becoming fully blocked or plugged.

SUMMARY OF THE INVENTION

These objects and others which will become apparent hereinafter are attained, in accordance with the present invention, in a piston having a fluid-medium passage communicating with the pressure-cushion shoe and a throttle constriction which is also provided with a large-surface gap filter capable of blocking the through-flow of particles of the same size or larger than the gap width or opening cross section of the throttle constriction and whose gap area or cross section is, however, so large that even when a number of particles accumulate in this gap, the flow cross section will not be impeded to the point that it will be less than the flow cross section of the throttle constriction.

In machines of the usual size and with conventional throttle constrictions, the gap width of such a gap filter can amount to 0.2 mm to 0.3 mm (inclusive) or even higher values if the throttle cross section is appropriately larger.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
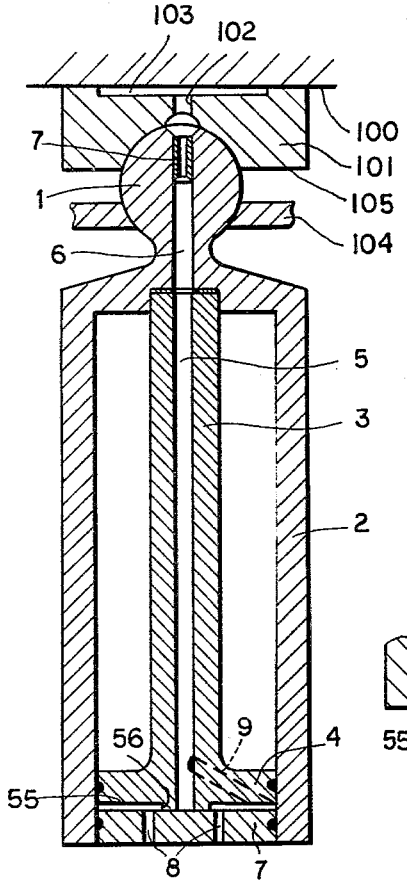
FIG. 1 is a somewhat diagrammatic axial cross-sectional view through a hollow piston provided with a transverse gap filter according to the invention.

FIG. 1 shows a hollow piston having a ball head 1 and a cylindrical hollow piston body 2 formed in a single piece, i.e. unitarily. The piston head 1 is shown diagrammatically to be swivelable in a ball socket 105 of a slide shoe 101 which is juxtaposed with a reaction surface 100 of, for example, a swashplate. In accordance with conventional practices, the slide shoe 101 can be formed with a cavity 103 open toward the reaction surface 100 and supplied with the pressure medium via a passage 102 to form the pressure cushion which normally provides a thin layer of the fluid between the shoe and the reaction surface. The shoe 101 therefore rides upon a film of the pressure medium. The piston is formed with a central column 3 and the latter can be bonded in a recess at the head end of the piston via a film of hard solder.

The central column is traversed by an axially extending longitudinal bore 5 which communicates with an axially extending longitudinal bore 6 in the ball head 1. At the outer end of this bore 6, there is provided a sleeve or bushing 7 which forms a throttle constriction of substantially smaller cross section than that of the bore 6 and the bore 5. The throttle 7 prevents an excessive flow of the hydraulic medium to the fluid cushion in the recess or cavity 103 and thereby prevents the shoe 101 from lifting excessively away from the reaction surface 100.

The open end of the hollow cylindrical body 2 is closed by a transverse flange or disk 4 formed unitarily with the slender shank of the post 3 and connected to the inner wall of the cylindrical body 2 by hard soldering.

A boss 56 of an axial length of 0.2 mm is formed centrally on the post 3 or, conversely, a peripheral recess 55 to the depth of 0.2 mm is formed in the end face of this post so that a circumferential gap of generally flat configuration in a plane perpendicular to that of the piston is provided. The gap is defined between a closure plate 6 fitted into the open end of the cylinder 2 and hard-soldered to the latter. The annular gap having a width of 0.2 mm communicates via bores 8, spaced from the central bore 5, with the working chamber of the cylinder 4 in which the piston is reciprocatable. From the annular gap, the fluid can pass through a transverse bore 9, shown in broken lines in FIG. 1, into the longitudinal bore 5 of post 3 and thence to the throttle 7 and the shoe.

Naturally, particles cannot pass into the bore 9 or through the passages 5–7 which have a larger particle size than 0.2 mm unless these particles have an extremely flat configuration, enabling them to traverse the flat transverse gap. It is highly improbable, in hydrostatic axial-piston machines, that the contaminants will have such a flat configuration.

Figure 1B:
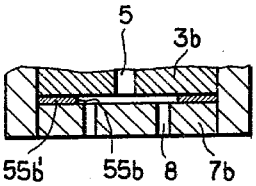
FIGS. 1A and 1B are fragmentary cross-sectional views of the working end of a piston similar to FIG. 1 but illustrating other embodiments of the transverse gap filter.
Figure 1A:
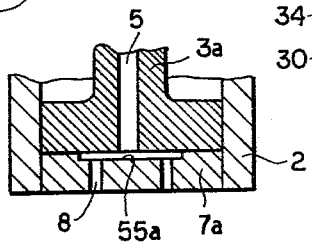

As can be seen from FIG. 1A, instead of forming the annular gap 5 by machining the post 3 in the manner described, it is possible to machine a flat recess **55*a* in the cover plate 7*a* which is secured within the piston body 2. In this case, the bore 5 can open directly into the annular gap and a separate passage 9 can be eliminated. Naturally, the bores 8 must be offset from the passage 5 formed in the post 3*a*** whose end can be perfectly planar.

Another alternative has been shown in FIG. 1B where between the planar end face of the post **3*b* and the planar juxtaposed face of the disk 7*b* provided with the bores 8, a ring 55*b*' of a foil having the thickness of 0.2 mm is disposed. This, naturally, provides a circular gap 55*b* of flattened configuration and an axial gap width of 0.2 mm. Here again, the transverse bore 9 can be eliminated. The embodiments of FIGS. 1A and 1B have been found to be somewhat more expensive to fabricate than the more preferred embodiment of FIG. 1**.

Figure 2:
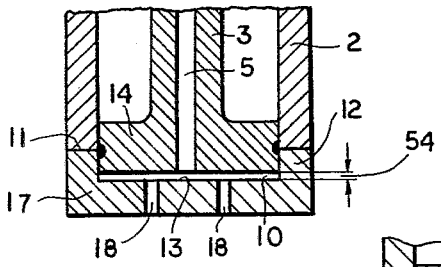
FIG. 2 is an axial cross-sectional view through the working end of another hollow piston according to the invention having a transverse gap filter.

In the embodiment of FIG. 2, the flange 14 which is hard-soldered to the hollow body 2 and is partially received within an inwardly concave cap 12 to which it is also hard-soldered, defines the annular gap 54 having an axial width of 0.2 mm between its planar end face 10 and the planar floor 13 of the recess defined in the cover 19 by an upstanding peripheral flange 12 whereby the cover is secured to the body 2. The peripheral flange or rim 12 of the cover is dimensioned to provide the gap 54 of the dimension indicated. The bores 18 in the floor of the cap 17 communicate with the gap 54 at locations offset from the central bore 5 of the post 3.

The embodiments of FIGS. 1 and 2 have a minor disadvantage in that the distances between the bores 8 or 18 and the central bore 5 are relatively short and thus the transition cross section between the bores is small and can be plugged more readily than in the embodiments to be described subsequently.

Figure 3:
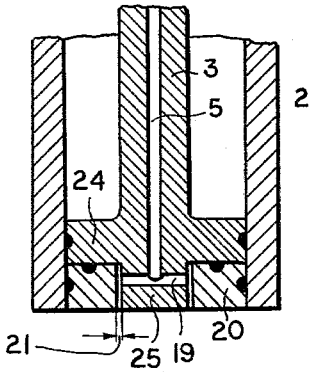

In the embodiment of FIG. 3, the terminal flange 24 of the post 3, which is hard-soldered to the inner wall of the hollow cylindrical piston body 2, is formed with a boss 25 axially aligned with the bore 5 but provided with a transverse or radial bore 19. Thus the bore 19 opens along the outer surface of the boss 25 rather than at the end thereof.

The boss 25 is, in turn, surrounded by a ring 20 which is hard-soldered to the end face of the flange 24 and to the inner wall of the cylindrical body 2 with the end of which it is flush or coplanar. The ring 20 is dimensioned so that a gap 21 having a radial gap width of about 0.2 mm is formed between its inner surface and the outer surface of the boss 25.

The filter gap 20 extends axially and communicates radially with the bore 19. This filter gap has a relatively large axial extent and, in addition, has a large cross section as measured in the plane perpendicular to the axis of the piston through the gap.

The gap 20 thus opens over its entire cross section directly at the end face of the piston and is, at this end face, continuously flushed with liquid so that the flushing hydraulic medium can serve to remove impurities which may from time to time become blocked by this filter gap 21. Even if such a continuous flushing does not occur, the total length of the annular gap is so great that it cannot be completely blocked by the impurities common in axial-piston machines.

Figure 4:
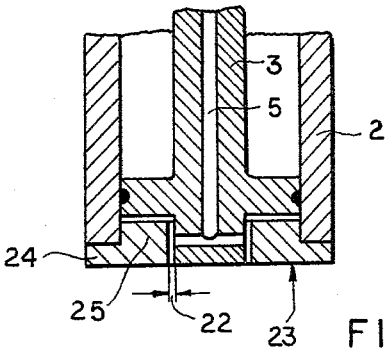
FIGS. 3 and 4 are axial cross-sectional views through the working ends of two hollow pistons having axially extending annular-gap filters in different embodiments of the invention.
Figure 5:
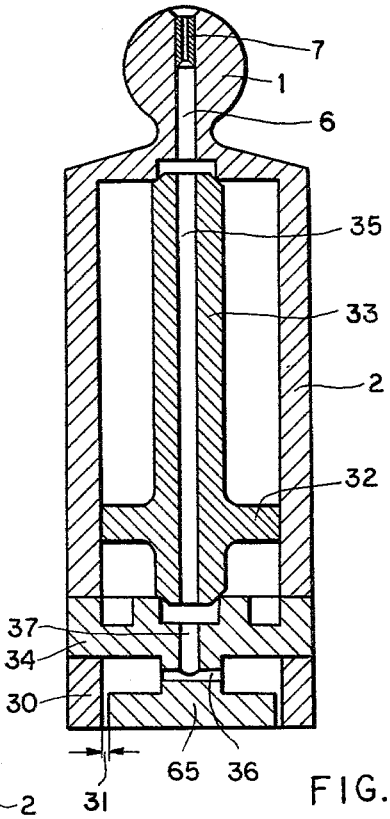
FIG. 5 is an axial cross-sectional view of yet another piston having an annular gap filter at the working end thereof.
Figure 6:
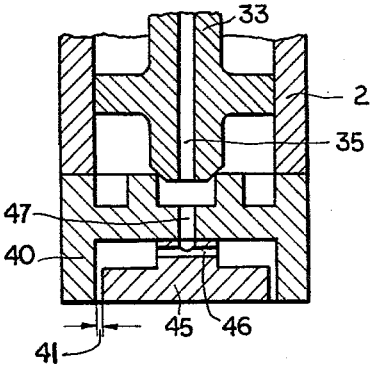
FIG. 6 is an axial cross-sectional view of the working end of yet a further hollow piston showing another variant of the axially extending annular gap filter.

The embodiments of FIGS. 4 through 6 have similar advantages over the transverse-gap embodiments of FIGS. 1 and 2 previously described.

The construction of FIG. 4 differs from that of FIG. 3 only in that the ring 23 is not wholly received in the piston 2 but is, instead, formed with a radial flange 24 which abuts the end face of the body 2 and with a cylindrical boss 25 which is received within the body 2. Nevertheless, it forms the annular gap 22 with the boss 25 of the post 3.

Yet another embodiment of the invention is illustrated in FIG. 5.

In this embodiment, the ball head 1 is formed unitarily with the hollow cylindrical body 2 of the piston and the central post 33 is set into this body but does not directly form a closure for the interior of the piston.

The shank of the post 33 is bonded to the head end of the piston by press-friction welding and carries, close to the opposite end, an annular disk or shoulder (flange) 32 which supports the inner wall of the body 2 to enable it to be gripped in a chuck of a turning machine. When so engaged in the chuck of a lathe, the end face of the body 2 can be machined and a bevel can be given to a central boss of the post 33 projecting axially beyond the disk 32. The closure for the piston 2 may be formed by a cover 34 which can be secured to the machined end face of the body 2 by friction-pressure welding while simultaneously welding an edge of a central boss of this cover to the bevel of the post 33.

The cover 34 is provided, in turn, with a transverse flange 65 and a radial bore 36 communicating with its axial bore which opens, in turn, into the central passage 35 of the post. The flange 65 defines the axially extending circumferential gap 31 with a ring 30 which can be secured to the cover 34 also by friction-pressure welding.

The term friction-pressure welding is used herein to refer to welding brought about by the relative displacement of two parts by pressing them together. The relative displacement is carried out at a sufficiently high speed that the friction between the engaging parts generates sufficient heat to fuse them together. The cylindrical inner surface of ring 30 and the cylindrical outer surface of flange 65 define a gap which functions in the same manner as the gap 22.

The embodiment of FIG. 6 differs from that of FIG. 5 only in that, instead of a ring 30, the cover 40 is provided with a cylindrical apron which surrounds a disk 45 whose central boss is provided with a transverse bore 46 communicating with an axial bore 47 in the cover. Member 45 can be secured to the cover 40 by friction-pressure welding. In this case, the gap 41 is defined between the outer cylindrical surface of the disk 45 and the inner cylindrical surface of the apron.

In the embodiments of FIGS. 5 and 6, as in the case of the embodiments of FIGS. 3 and 4, the filter gap 31, 41 opens at the end face of the piston over a large cross-sectional area.

I claim:

1. A piston for a hydrostatic axial-piston machine, comprising:

a hollow cylindrical piston body formed at one end with a head of ball configuration engageable with a slide shoe adapted to form a pressure cushion against a reaction surface relative to which the shoe is displaceable, and open at the other end of said piston body, said head being formed with a first passage for communicating with a pressure cushion and having a throttle constriction in the ball for delivering a pressure medium to a pressure cushion through said throttle constriction;

a separate cover affixed to said other end of said body and formed with at least one wall closing the interior thereof and provided with an axially extending second passage communicating between an end face of said body and the interior thereof;

a separate member received in the interior of said body and including an elongated stem radially spaced from an inner cylindrical surface of said body and provided with a throughgoing axial bore registering with said first passage, and an annular flange extending outwardly from said stem and sealing against an inner cylindrical surface of said body; and a third passage defining a planar gap filter communicating between said second passage and said bore, said planar gap filter being defined by a space between adjacent planar opposed surfaces on said cover and said annular flange and having an axial width of about 0.2 to 0.3 mm and sufficiently small to prevent particles capable of obstructing said constriction from reaching same.

* * * * *